US012703551B2

(12) United States Patent
Gift et al.

(10) Patent No.: US 12,703,551 B2
(45) Date of Patent: Aug. 11, 2026

(54) TAMPER EVIDENT CLOSURE

(71) Applicant: BERRY GLOBAL, INC., Evansville, IN (US)

(72) Inventors: Steven Daniel Gift, Lititz, PA (US); Frank Allen Bond, York, PA (US)

(73) Assignee: BERRY GLOBAL, INC., Evansville, IN (US)

( * ) Notice: Subject to any disclaimer, the term of this patent is extended or adjusted under 35 U.S.C. 154(b) by 131 days.

(21) Appl. No.: 18/621,574

(22) Filed: Mar. 29, 2024

(65) Prior Publication Data

US 2024/0327081 A1 Oct. 3, 2024

Related U.S. Application Data

(60) Provisional application No. 63/456,269, filed on Mar. 31, 2023.

(51) Int. Cl.
*B65D 50/04* (2006.01)

(52) U.S. Cl.
CPC ..... *B65D 50/041* (2013.01)

(58) Field of Classification Search
CPC ..... B65D 50/041; B65D 2215/02; B65D 2215/00; B65D 2215/04
See application file for complete search history.

(56) References Cited

U.S. PATENT DOCUMENTS

| | | | | |
|---|---|---|---|---|
| 11,208,241 | B1 | 12/2021 | Gillman | |
| 2002/0027119 | A1 | 3/2002 | Miceli | |
| 2016/0257462 | A1 | 9/2016 | Baughman | |
| 2020/0289369 | A1* | 9/2020 | Gift | B65D 47/24 |
| 2021/0179323 | A1* | 6/2021 | Kreinbrink | B65D 50/041 |
| 2023/0406582 | A1* | 12/2023 | Bois | B65D 41/005 |

FOREIGN PATENT DOCUMENTS

| | | | |
|---|---|---|---|
| EP | 0631944 | A1 | 1/1995 |
| WO | 2018144721 | A1 | 8/2018 |

OTHER PUBLICATIONS

International (PCT) Search Report and Written Opinion for PCT/EP2024/058763 dated Jun. 21, 2024, 14 pages.

* cited by examiner

*Primary Examiner* — Shawn M Braden
(74) *Attorney, Agent, or Firm* — Barnes & Thornburg LLP

(57) ABSTRACT

A child-resistant closure, comprising: an inner shell and an outer shell; wherein the inner shell includes at least one inner lug; wherein the outer shell includes at least one outer lug; wherein the outer lug is movable relative to the inner lug between an engaged position and a disengaged position; wherein in the disengaged position the outer lug is able to rotate past the inner lug when rotated in an opening direction; wherein in the engaged position the outer lug engages the inner lug when rotated in an opening direction to cause opening direction rotation of the inner shell; and an annular band disposed on the inner shell between an inner shell top panel and a shelf; wherein the shelf is disposed axially lower than the top panel; wherein the at least one inner lug extends upwardly from the shelf.

18 Claims, 8 Drawing Sheets

TAMPER EVIDENT CLOSURE

PRIORITY CLAIM

This application claims priority under 35 U.S.C. § 119(e) to U.S. Provisional Application No. 63/456,269, filed Mar. 31, 2023, which is expressly incorporated by reference herein.

BACKGROUND

The present disclosure relates generally to a closure, and more specifically to a light weight child resistant closure for a container.

SUMMARY

According to the present disclosure, certain embodiments according to the present disclosure provide a light weight closure with child resistant features for a container.

In illustrative embodiments, a child-resistant closure, comprises an inner shell and an outer shell;

wherein the inner shell includes at least one inner lug;

wherein the outer shell includes at least one outer lug;

wherein the outer lug is movable relative to the inner lug between an engaged position and a disengaged position;

wherein in the disengaged position the outer lug is able to rotate past the inner lug when rotated in an opening direction;

wherein in the engaged position the outer lug engages the inner lug when rotated in an opening direction to cause opening direction rotation of the inner shell; and an annular band disposed on the inner shell between an inner shell top panel and a shelf;

wherein the shelf is disposed axially lower than the top panel;

wherein the at least one inner lug extends upwardly from the shelf.

In some embodiments the at least one inner lug extends upwardly to a highest point at a tip, and wherein the tip is aligned with a top surface of the annular band.

The closure may further comprise at least one rib disposed on an outer surface of a skirt of the inner shell.

In some embodiments a plurality of equidistant inner ramps are arranged around the perimeter of the inner shell, with a cam or angled first face and a relatively vertically or axially oriented second face and an inner ramp tip at the intersection of first face and second face.

Inner ramps may have an angled outer surface, which angles radially inwardly as it extends axially upwardly.

Inner ramp tips may be approximately planar or horizontally aligned or flush with an annular band.

A transition surface may be provided between the annular band and the shelf, and it may be angled, whereby to allow inner skirt to be shorter and/or include less material to allow a lighter weight closure.

The annular band may provide structural rigidity in the form of hoop strength to enhance rigidity of inner shell, to allow reduction in material for light weighting.

The inner skirt may include one or more ribs to provide structural rigidity to allow reduction and/or lightweighting of material.

The inner shell may include an internal thread for rotation engagement of an external thread of a container, so that closure and/or inner shell may be rotationally removed from and/or attached to an underlying container.

The outer shell may include a top panel with an outer skirt depending axially downwardly therefrom toward an outer shell bottom.

The outer shell may include an outer bead to retain inner shell in a nested position within outer shell.

The inner shell bottom end may flare outwardly to engaged with outer bead so inner shell is retained within outer shell.

The outer shell may include a plurality of outer ramps that have an angled first face and/or a relatively vertical second face, with an outer ramp tip disposed between first face and second face.

Outer ramps may extend radially inwardly from an outer edge to an inner edge.

Inner ramps and outer ramps may be configured such that first face of inner ramps and the first face of outer ramps can cam or pass one another when in a resting condition and when outer shell is rotated relative to inner shell in a direction that would remove it from an underlying container.

In some embodiments user input pushing the outer shell downward toward the inner shell is needed to provide enough force or friction for outer ramps to engage inner ramps to cause rotation of inner shell by rotation of outer shell, whereby to provide a "push and turn" style child resistant closure.

The outer ramp second face and/or inner ramp second face may be relatively vertical in the axial direction compared to the outer ramp first face and/or inner ramp first face such that no camming occurs and attachment motion causes rotation of the inner shell in an attachment direction to an underlying container whether a downward push force is present or not.

In some embodiments the closure and/or inner shell can attach or coupled to an underlying container by a simple rotation of the outer shell with or without a first user input or downward push force on outer shell.

A recess between outer bead and outer top panel may be axially longer than the inner shell such that inner shell floats axially within outer shell.

In some embodiments when inner shell is all the way up in the axial direction relative to outer shell, as the case may be when outer shell is pushed down into an unlocked position, the inner shell bottom is separated an axial distance from the outer bead.

In some embodiments when inner shell is all the way down in the axial direction relative to outer shell and/or when inner bottom contacts outer bead, outer ramps and inner ramps may be spaced apart such that they would not engage, which may provide an exemplary locked position in which rotation of outer shell would not cause rotation and/or removal of inner shell from an underlying container.

The first face of outer ramp is angled and/or first face of inner ramp may be angled to facilitate the aforementioned camming action or passing of the outer ramp past the inner ramp in the absence of a sufficient down force, and in which in the opposite direction, the relatively vertical second face of outer ramp and the relatively vertical second face of outer ramp may for a mechanical stop sufficient to cause rotation of inner shell by rotation of outer shell in a direction that would cause second face and second face to abut.

A further aspect provides a child-resistant closure comprising an inner shell and an outer shell, the inner shell has at least one lug, the outer shell has at least one lug, the inner shell is nested within the outer shell and the closure is configured to allow axial movement of inner shell relative to outer shell such that inner shell floats axially within outer shell and in which when outer shell is moved downwardly relative to inner shell into an unlocked position, a user may rotate outer shell to cause rotation of inner shell and/or removal of inner shell from an underlying container, in which when outer shell is moved upwardly relative to inner shell into a locked position, the outer shell is disengaged from the inner shell such that the outer shell rotates freely relative to the inner shell and/or does not cause rotation of inner shell and/or removal of inner shell from an underlying container, in which to facilitate moving between the locked and unlocked positions, the inner shell includes a plurality of inner lugs or ramps and the outer shell includes a plurality of outer lugs or ramps which can selectively engage one another.

The inner shell may have a top panel with an inner shell skirt depending downwardly in the axial direction from top panel toward an inner shell bottom.

An annular band may be provided between a top panel and a shelf, with the shelf disposed axially lower or below the top panel.

In aspects and embodiments of the present disclosure, a closure may be engageable with a container by threaded engagement. Corresponding screw thread formations (e.g. single or multi-start) may be provided on a closure and a container neck, for example.

The present disclosure also provides a closure as described herein in combination with a container.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 1:
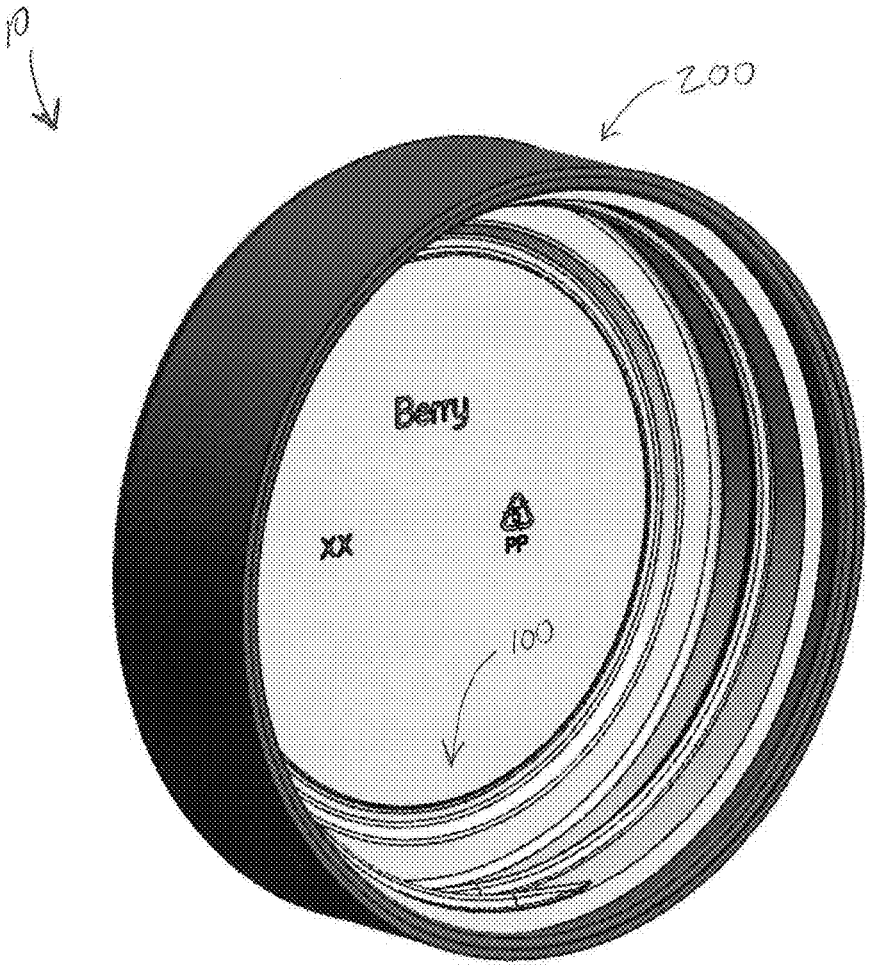
FIG. 1 illustrates a bottom perspective view of an embodiment of a closure having an inner shell nested within an outer shell.
Figure 13:
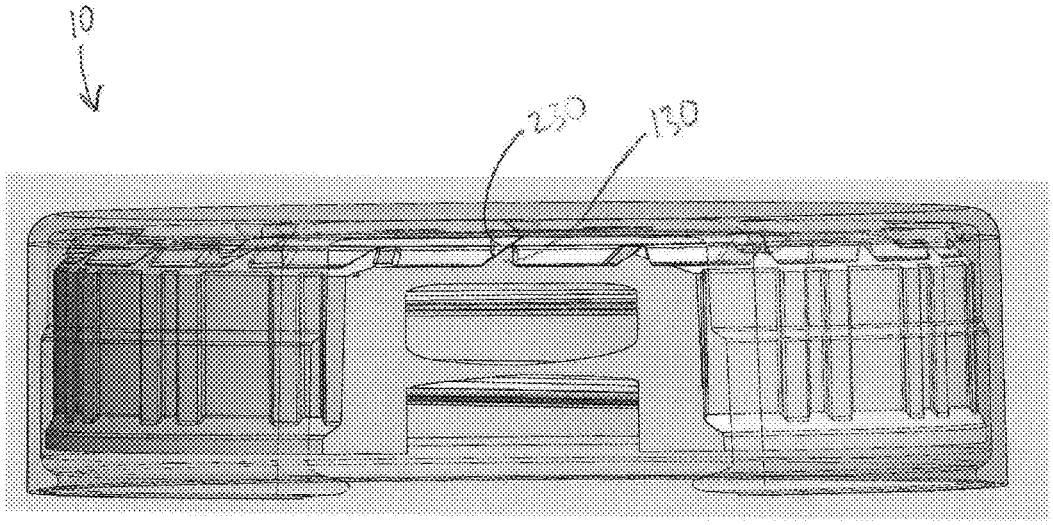
Figure 14:
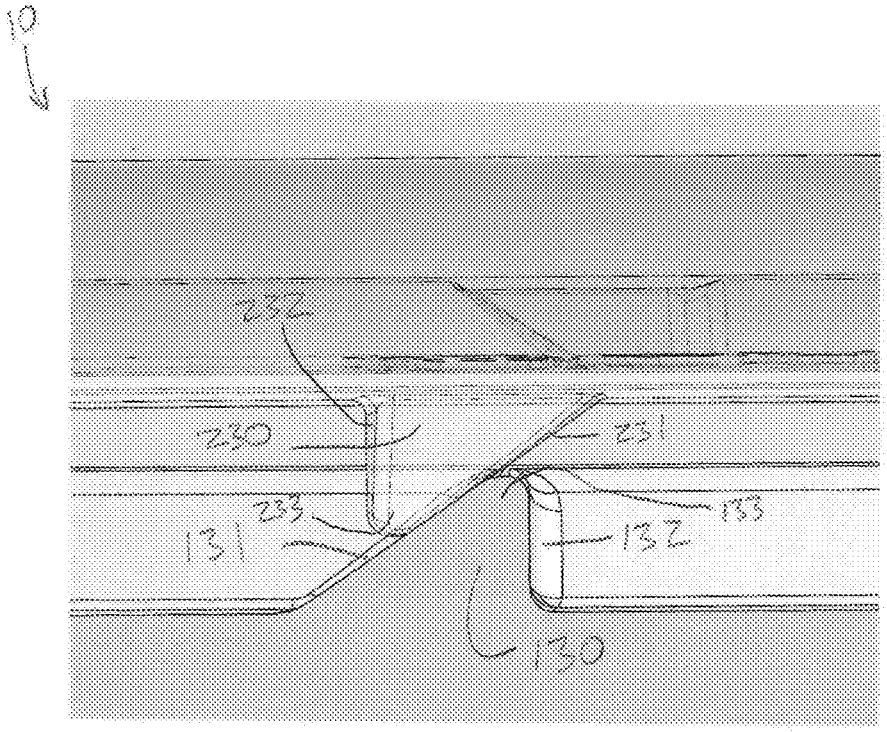

FIG. 13 illustrates a side perspective view of the closure of FIG. 1, with the outer shell shown in a translucent state so that features of the inner shell are visible, and with a portion of the outer shell and inner shell cut away to show internal features in more detail, for example, the way in which the outer ramps and the inner ramps engage when the outer shell is rotated about a central axis relative to the inner shell; and FIG. 14 illustrates a close-up view of a portion of FIG. 13 to show an outer ramp and an inner ramp in more detail.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Some embodiments of a closure 10 may include an inner shell 100 and an outer shell 200, as shown for example in FIG. 1. Inner shell 100 may be nested within outer shell 200 and/or may be configured to allow axial movement of inner shell 100 relative to outer shell 200 such that inner shell 100 may float axially within outer shell 200, for example. When outer shell 200 is moved downwardly relative to inner shell into an unlocked position, a user may rotate outer shell 200 to cause rotation of inner shell 100 and/or removal of inner shell 100 from an underlying container by a threaded engagement, for example. When outer shell 200 is moved upwardly relative to inner shell 100 into a locked position, outer shell 200 may be disengaged from inner shell 100 such that outer shell 200 rotates freely relative to inner shell 100 and/or does not cause rotation of inner shell 100 and/or removal of inner shell 100 from an underlying container. To facilitate providing and/or moving between the locked and unlocked positions, inner shell 100 may include a plurality of inner lugs or ramps 130 and/or outer shell 200 may include a plurality of outer lugs or ramps 230, which may selectively engage one another as discussed more below.

Figure 2:
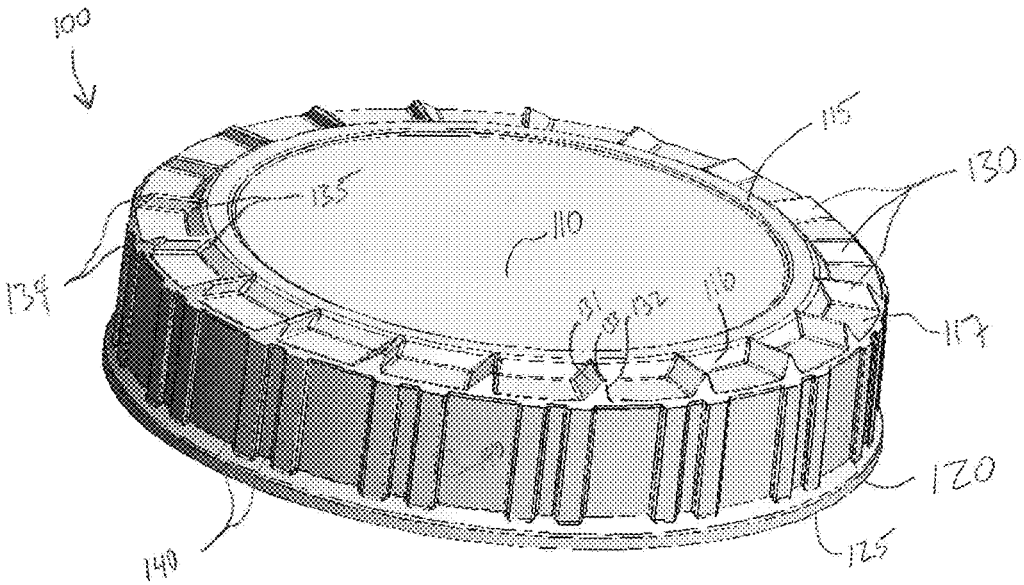
FIG. 2 illustrates a top perspective view of an embodiment of an inner shell for use in the closure shown in FIG. 1, with the inner shell having a plurality of inner lugs on the top for selective engagement with the outer shell shown in FIG. 1.
Figure 3:
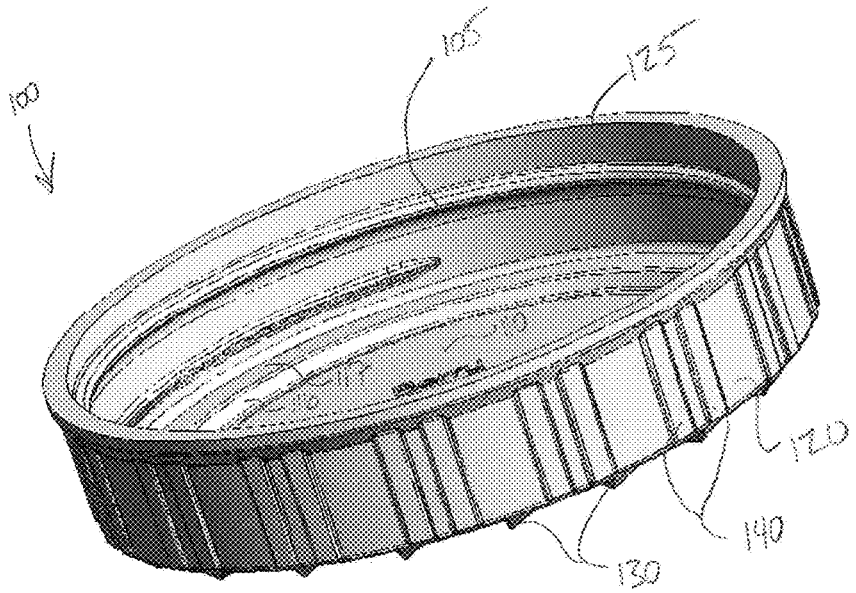
FIG. 3 illustrates a bottom perspective view of the inner shell of FIG. 2.
Figure 4:
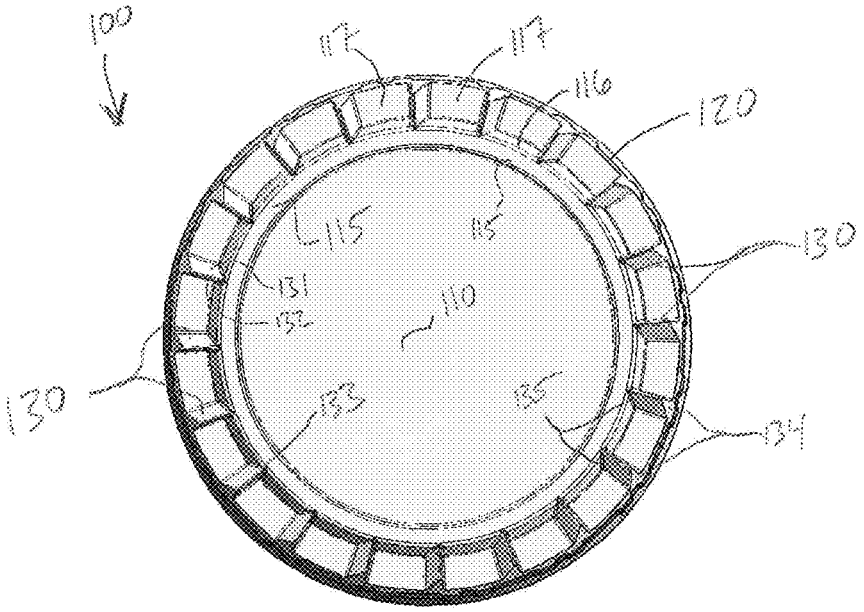
FIG. 4 illustrates a top view of the inner shell of FIG. 2.
Figure 5:
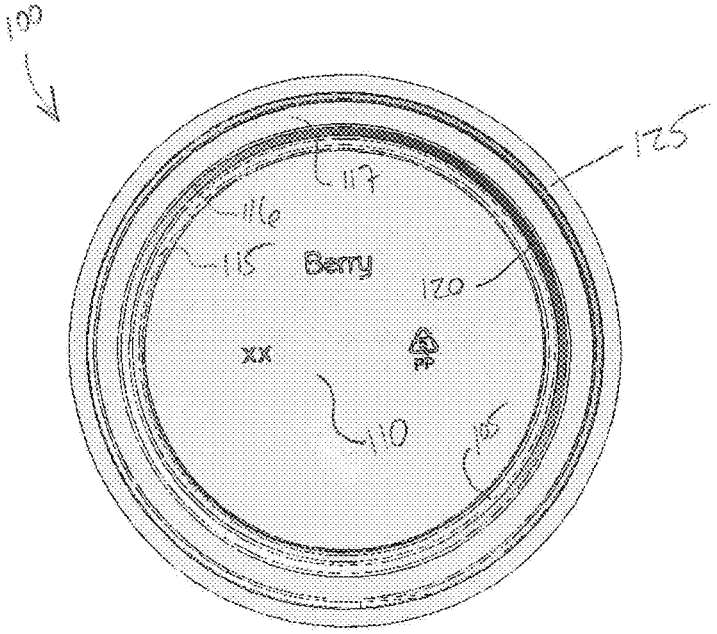
FIG. 5 illustrates a bottom view of the inner shell of FIG. 2.
Figure 6:
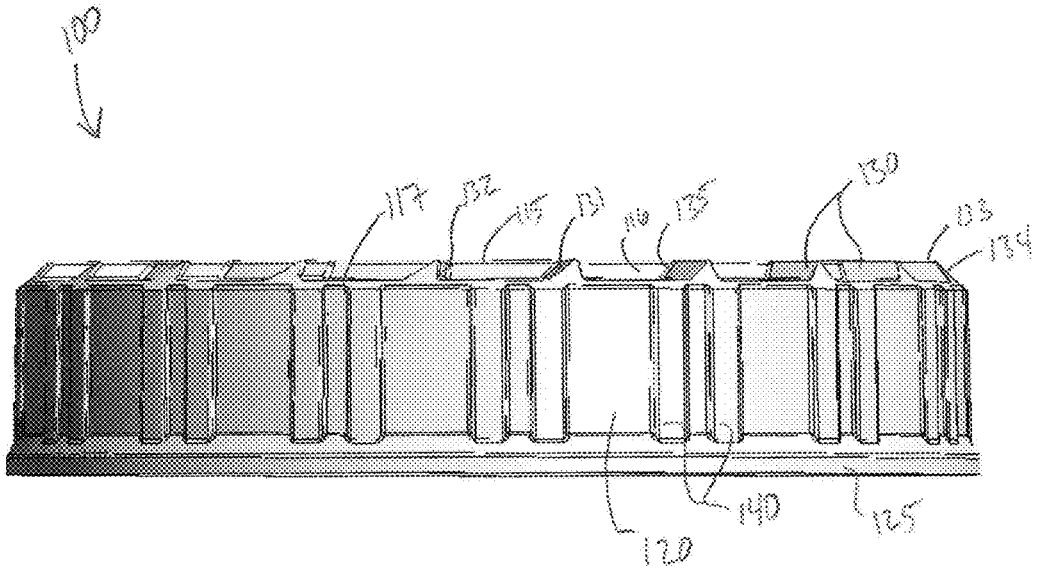
FIG. 6 illustrates a side view of the inner shell of FIG. 2.
Figure 7:
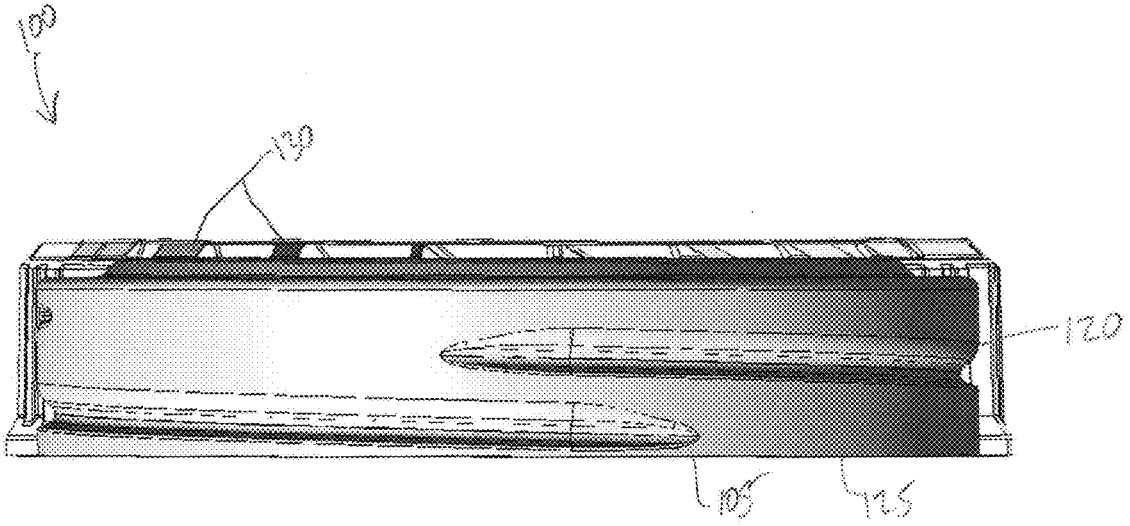
FIG. 7 illustrates a cross-section side view of the inner shell of FIG. 6.

FIG. 2 illustrates inner shell 100 having a top panel 110 with an inner shell skirt 120 depending downwardly in the axial direction from top panel 110 toward inner shell bottom 125. A plurality of equidistant inner ramps 130 are shown arranged around the perimeter of inner shell 100, with a cam or angled first face 131 and a relatively vertically or axially oriented second face 132 and an inner ramp tip 133 at the intersection of first face 131 and second face 132. Inner ramps 130 may have an angled outer surface 134, which may angle radially inwardly as it extends axially upwardly. Inner ramp tips 133 may be approximately planar or horizontally aligned or flush with an annular band 115. Annular band 115 may be provided between top panel 110 and a shelf 117, with shelf 117 disposed axially lower or below top panel 110. A transition surface 116 may be provided between annular band 115 and shelf 117, and it may be angled as shown for example in FIG. 2. This may allow inner skirt 120 to be shorter and/or include less material to allow a lighter weight closure 10. Annular band 115 may provide structural rigidity in the form of hoop strength, for example, or otherwise to enhance rigidity of inner shell 100, to allow reduction in material for light weighting, and/or for any other reason. Inner skirt 120 may include one or more ribs 140 to provide structural rigidity to allow reduction and/or light weighting of material, or for any other reason.

FIGS. 3-7 show inner shell 100 in additional detail. Inner shell 100 may include an internal thread 105 for rotation engagement of an external thread of a container, or for any other reason, for example so that closure 10 and/or inner shell 100 may be rotationally removed from and/or attached to an underlying container. Inner shell 100 may be made from polypropylene (PP) or from any other suitable material, including other plastics material or a combination thereof.

Figure 8:
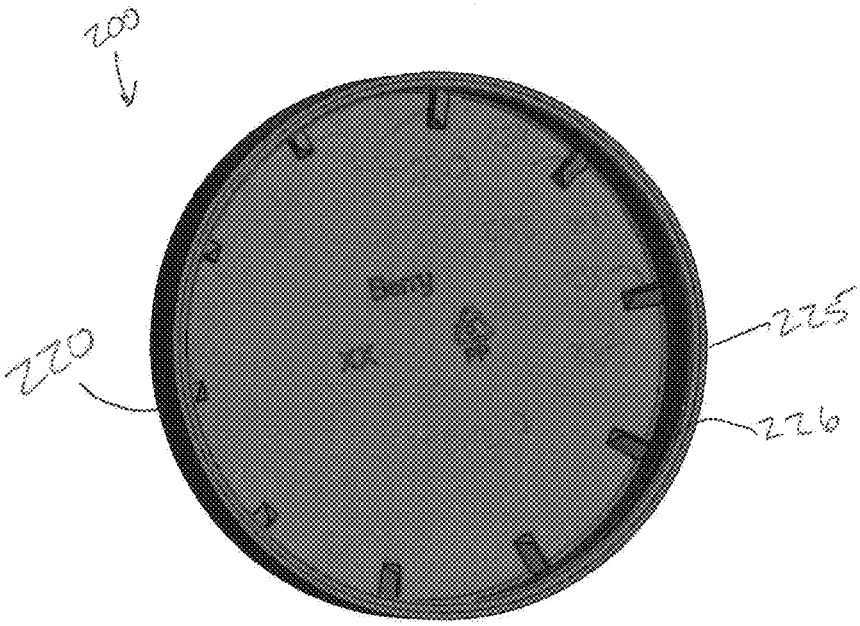
FIG. 8 illustrates a bottom perspective view of an embodiment of an outer shell for use in the closure of FIG. 1.

FIG. 8 shows the inside or underside of outer shell 200 with inner shell 100 removed from closure 10 to show outer shell 200 in more detail. Outer shell 200 may include a top panel 210 with an outers skirt 220 depending axially downwardly therefrom toward an outer shell bottom 225. Outer shell 200 may include an outer bead 226 to retain inner shell 100 in a nested position within outer shell 200 or for any other reason or a variety of reasons. For example, inner shell 100 bottom end 125 may flare outwardly to engaged with outer bead 226 so inner shell 100 is retained within outer shell 200. Outer shell 200 may include a plurality of outer ramps 230 that may have an angled first face 231 and/or a relatively vertical second face 232, with an outer ramp tip 233 disposed between first face 231 and second face 232. Outer ramps 230 may extend radially inwardly from an outer edge 234 to an inner edge 235.

Figure 9:
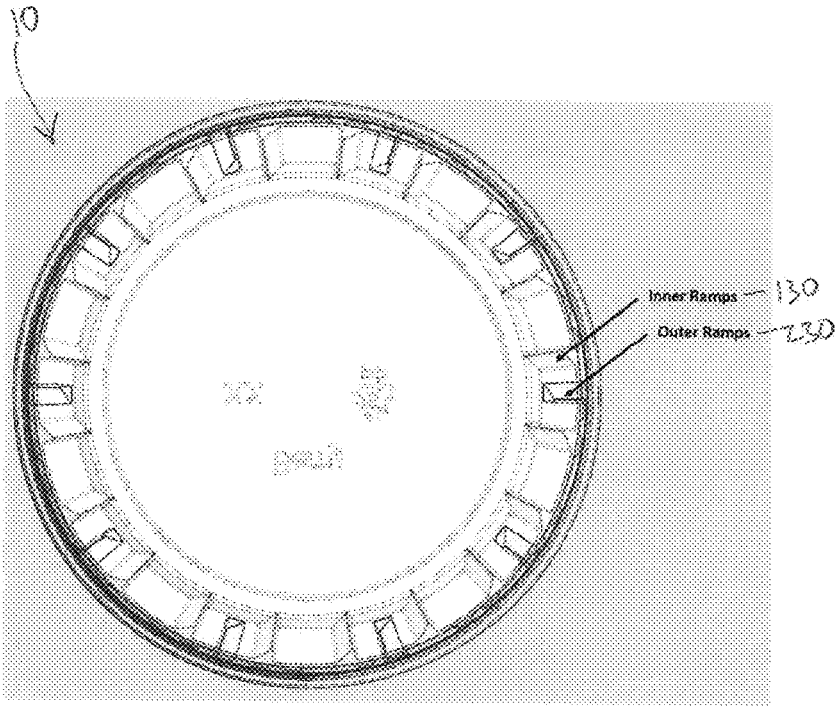
FIG. 9 illustrates a top view of the closure of FIG. 1 with the outer shell shown in a translucent state to illustrate features of the inner shell such that the inner ramps of the inner shell and the outer ramps of the outer shell can both be seen, for example.
Figure 10:
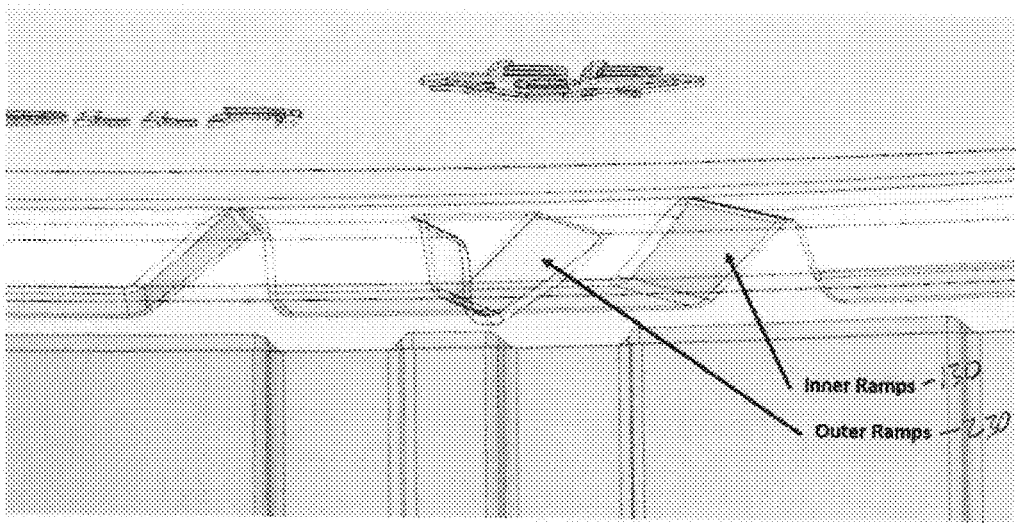
FIG. 10 illustrates a close-up, side perspective view of an outer perimeter area of the closure where a side wall and a top panel intersect, with the outer shell again shown in a translucent state so that features of the inner shell are visible, and with the closure shown in a resting condition in which the outer shell is allowed to fall until it contacts the top of the inner shell.

Inner shell 100 and outer shell 200 may be combined to form closure 10 as shown for example in FIGS. 9 and 10. Inner ramps 130 and outer ramps 230 may be configured such that first face 131 of inner ramps 130 and first face 231 of outer ramps 230 may cam or pass one another when in a resting condition and when outer shell 200 is rotated relative to inner shell 100, for example, when outer shell 200 is rotated in a counterclockwise (CCW) direction that would rotate inner shell 100 in a direction that would remove it from an underlying container. A first user input pushing outer shell 200 downward toward inner shell 100 may be needed to provide enough force or friction for outer ramps 230 to engage inner ramps 130 to cause rotation of inner shell 100 by rotation of outer shell 200. This may provide a "push and turn" style child resistant closure. Outer ramp second face 232 and/or inner ramp second face 132 may be relatively vertical in the axial direction compared to first face 231 and/or first face 131 such that no camming occurs and attachment motion, such as clockwise (CW) rotation of outer shell 200 would cause rotation of inner shell 100 in an attachment direction to an underlying container via thread 105 whether a downward push force was present or not. In this way, for example, closure 10 and/or inner shell 100 may be attached or coupled to an underlying container by a simple CW rotation of outer shell 200 with or without a first user input or downward push force on outer shell 200.

Figure 11:
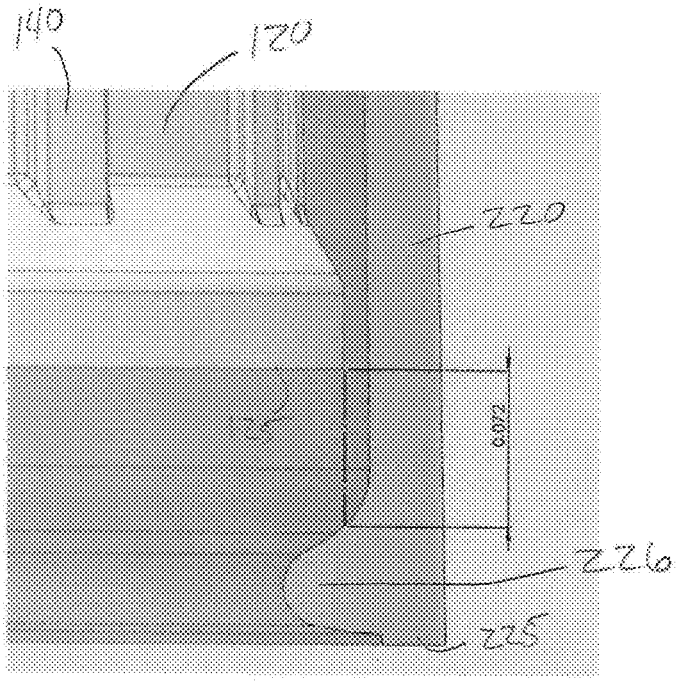
FIG. 11 illustrates a close-up side view of a lower area of the closure with the outer shell shown in cross-section so that features of the outer shell and inner shell can be viewed, with the closure in the resting condition shown in FIG. 10, and with the bottom of the inner shell being positioned an exemplary distance of 0.072 inches above the bead of the outer shell.
Figure 12:
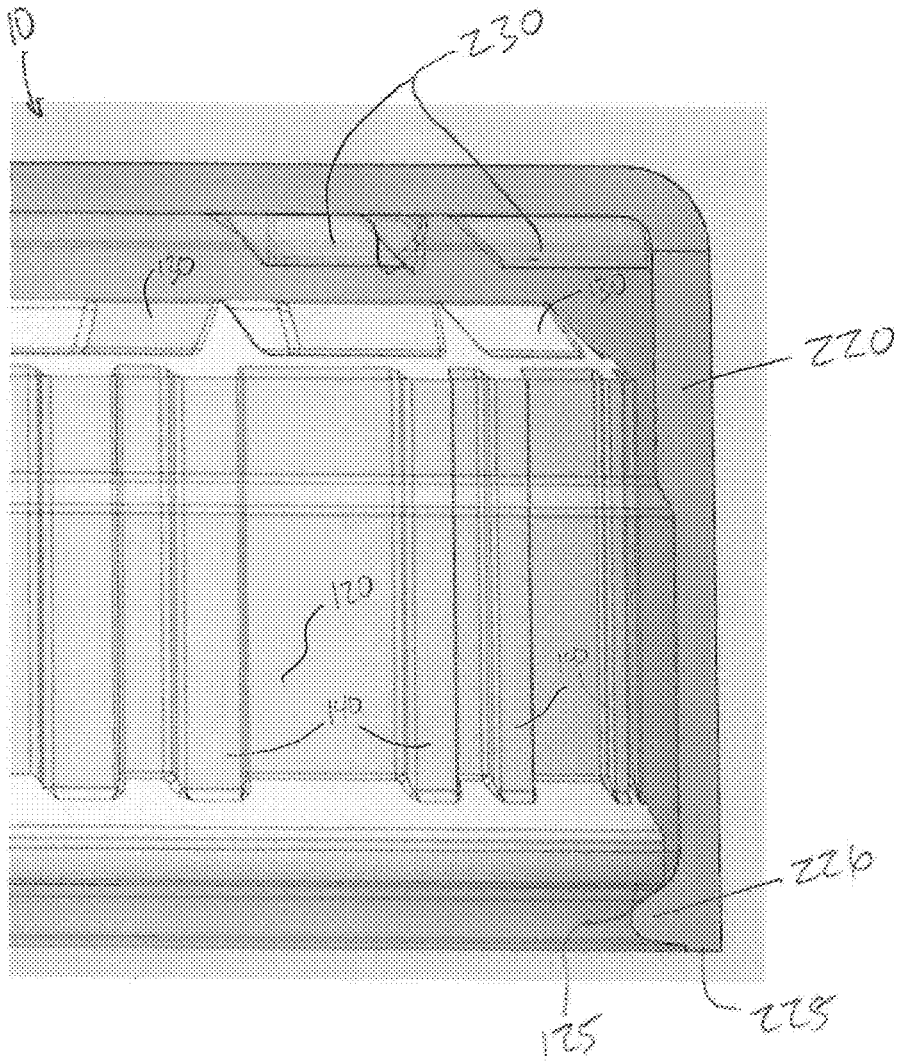
FIG. 12 illustrates a side view of a portion of the closure of FIG. 1 with the outer shell shown in cross-section, with the closure shown in an extended position in which the outer shell is moved upwardly relative to the inner shell until the bead of the outer shell shown in FIG. 11 contacts the bottom of the inner shell shown.

As shown in FIG. 11, a recess between outer bead 226 and outer top panel 210 may be axially longer than inner shell 100 such that inner shell 100 may float axially within outer shell 200. When inner shell 100 is all the way up in the axial direction relative to outer shell 200, as the case may be when outer shell 200 is pushed down into an unlocked position, inner bottom 125 may be separated an axial distance from outer bead 226, which is shown as the exemplary dimension of 0.072" in FIG. 11. When inner shell 100 is all the way down in the axial direction relative to outer shell 200 and/or when inner bottom 125 contacts outer bead 226, outer ramps 230 and inner ramps 130 may be spaced apart such that they would not engage, which may provide an exemplary locked position in which rotation of outer shell 200 would not cause rotation and/or removal of inner shell 100 from an underlying container.

FIGS. 13 and 14 illustrate the engagement of inner ramps 130 and outer ramps 230 in additional detail. First face 231 of outer ramp 230 may be angled and/or first face 131 of inner ramp 130 may be angled to facilitate the aforementioned camming action or passing of outer ramp 230 past inner ramp 130 in the absence of a sufficient down force. In the opposite direction, the relatively vertical second face 232 of outer ramp 230 and the relatively vertical second face 132 of outer ramp 130 may for a mechanical stop sufficient to cause rotation of inner shell 100 by rotation of outer shell 200 in a direction that would cause second face 132 and second face 232 to abut.

It is understood that, while some directional terms are used herein, such as top, bottom, upper, lower, inward, outward, upward, downward, etc., these terms are not intended to be limiting but rather to relate to one or more exemplary orientations, positions, and/or configurations of closure 10, and/or any component thereof. It is understood closure 10, and/or any component or portion thereof may be inverted or re-oriented to face or point a different direction without departing from the nature of closure 10 disclosed herein.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.S It is often desirable to store product or contents in a container or package. It is often desirable to close the container with a closure. A closure may be provided with child resistant features. The closure may have a relatively low weight yet high strength.

The invention claimed is:

1. A child-resistant closure, comprising:

an inner shell and an outer shell;

wherein the inner shell includes at least one inner lug;

wherein the outer shell includes at least one outer lug;

wherein the outer lug is movable relative to the inner lug between an engaged position and a disengaged position;

wherein in the disengaged position the outer lug is able to rotate past the inner lug when rotated in an opening direction;

wherein in the engaged position the outer lug engages the inner lug when rotated in an opening direction to cause opening direction rotation of the inner shell; and an annular band disposed on the inner shell between an inner shell top panel and a shelf;

wherein the shelf is disposed axially lower than the inner shell top panel;

wherein the at least one inner lug extends upwardly from the shelf, wherein the at least one inner lug extends upwardly to a highest point at a tip, and wherein the tip is aligned in a vertical direction with a top surface of the annular band such that the tip is flush with the top surface of the annular band.

2. The closure according to claim 1, in which a plurality of equidistant inner lugs are arranged around the perimeter of the inner shell, with a cam or angled first face and a relatively vertically or axially oriented second face and an inner tip at the intersection of the first face and the second face.

3. The closure according to claim 2, in which inner lugs have an angled outer surface, which angles radially inwardly as it extends axially upwardly.

4. The closure according to claim 1, in which a transition surface is provided between the annular band and the shelf, and the transition surface is angled to allow the inner skirt to be shorter and/or include less material to allow a lighter weight closure.

5. The closure according to claim 1, in which the inner shell includes an internal thread for rotation engagement of an external thread of a container, so that the closure and/or the inner shell may be rotationally removed from and/or attached to an underlying container.

6. The closure according to claim 1, in which the outer shell includes a top panel with an outer skirt depending axially downwardly therefrom toward an outer shell bottom.

7. The closure according to claim 1, in which the outer shell includes an outer bead to retain the inner shell in a nested position within the outer shell.

8. The closure according to claim 7, in which the inner shell bottom end flares outwardly to engaged with the outer bead so the inner shell is retained within the outer shell.

9. The closure according to claim 1, in which the outer shell includes a plurality of outer lugs that have an angled first face and a relatively vertical second face, with an outer tip disposed between first face and second face.

10. The closure according to claim 9, in which outer lugs extend radially inwardly from an outer edge to an inner edge.

11. The closure according to claim 1, in which the inner shell comprises inner lugs and the outer shell comprises outer lugs, the inner and outer ramps are configured such that a first face of the inner lugs and a first face of the outer lugs pass one another when in a resting condition and when the outer shell is rotated relative to the inner shell in a direction that would remove it from an underlying container.

12. The closure according to claim 11, in which user input pushing the outer shell downward toward the inner shell with a predetermined force for the outer lugs to engage the inner lugs allows rotation of the inner shell by rotation of the outer shell.

13. The closure according to claim 11, in which the outer lug second face and/or inner lug second face are relatively vertical in the axial direction compared to the outer lug first face and/or inner lug first face such that no camming occurs and rotation of the inner shell in an attachment direction to an underlying container causes rotation of the inner shell whether a downward push force is present or not.

14. The closure according to claim 1, in which a recess between outer bead and outer top panel is axially longer than a height of the inner lug such that inner shell floats axially within outer shell.

15. The closure according to claim 1, in which when inner shell is all the way up in the axial direction relative to outer shell, as the case may be when outer shell is pushed down into an unlocked position, the inner shell bottom is separated an axial distance from the outer bead.

16. The closure according to claim 1, in which the inner shell comprises inner lugs and the outer shell comprises outer lugs, in which the outer shell includes an outer bead to retain inner shell in a nested position within outer shell, in which when inner shell is all the way down in the axial direction relative to outer shell and/or when inner bottom contacts outer bead, the outer lugs and the inner lugs are spaced apart such that they do not engage, which provides a locked position in which rotation of outer shell do not cause rotation and/or removal of inner shell from an underlying container.

17. The closure according to claim 1, in which a plurality of equidistant inner lugs are arranged around the perimeter of the inner shell, with a cam or angled first face and a relatively vertically or axially oriented second face and an inner tip at the intersection of the first face and the second face, in which the outer shell includes a plurality of outer lugs that have an angled first face and/or a relatively vertical second face, with an outer tip disposed between first face and second face, in which the first face of each outer lug is angled and/or the first face of each inner lug is angled to facilitate a camming action or passing of the outer lugs past the inner lugs in the absence of a sufficient down force, and in which in the opposite direction, the relatively vertical second face of the outer lugs and the relatively vertical second face of the outer lugs provide a mechanical stop sufficient to cause rotation of inner shell by rotation of outer shell in a direction that cause the second face of the inner lugs and the second face of the outer lugs to abut.

18. A child-resistant closure comprising an inner shell and an outer shell, the inner shell has at least one lug, the outer shell has at least one lug, the inner shell is nested within the outer shell and the closure is configured to allow axial movement of the inner shell relative to the outer shell such that the inner shell floats axially within the outer shell and in which when the outer shell is moved downwardly relative to the inner shell into an unlocked position, a user may rotate the outer shell to cause rotation of the inner shell and/or removal of the inner shell from an underlying container, in which when the outer shell is moved upwardly relative to the inner shell into a locked position, the outer shell is disengaged from the inner shell such that the outer shell rotates freely relative to the inner shell and/or does not cause rotation of the inner shell and/or removal of the inner shell from an underlying container, in which to facilitate moving between the locked and unlocked positions, the inner shell includes a plurality of inner lugs and the outer shell includes a plurality of outer lugs which can selectively engage one another, wherein an entirety of the outer shell is configured to move between the locked position and the unlocked position.

* * * * *